US008291806B2

(12) United States Patent
Rael

(10) Patent No.: US 8,291,806 B2
(45) Date of Patent: Oct. 23, 2012

(54) HELICAL AMMUNITION MAGAZINE

(76) Inventor: Paul J Rael, Las Vegas, NV (US)

( * ) Notice: Subject to any disclaimer, the term of this patent is extended or adjusted under 35 U.S.C. 154(b) by 15 days.

(21) Appl. No.: 12/979,179

(22) Filed: Dec. 27, 2010

(65) Prior Publication Data

US 2012/0160083 A1 Jun. 28, 2012

(51) Int. Cl.
*F41A 9/74* (2006.01)

(52) U.S. Cl. ..... 89/33.02

(58) Field of Classification Search ..... 89/33.02, 89/33.01, 33.1, 33.17, 34, 33.16, 33.25, 33.5; 42/19, 49.01
See application file for complete search history.

(56) References Cited

U.S. PATENT DOCUMENTS

| | | | | | |
|---|---|---|---|---|---|
| 84,685 | A | * | 12/1868 | Evans | 42/49.01 |
| 213,555 | A | | 3/1879 | Evans | |
| 1,329,979 | A | * | 2/1920 | Lang | 89/33.02 |
| 1,330,873 | A | * | 2/1920 | Hulse | 89/33.02 |
| 1,629,652 | A | * | 5/1927 | Browning | 89/33.02 |
| 2,064,888 | A | * | 12/1936 | Dickinson | 42/6 |
| 2,139,691 | A | * | 12/1938 | Michal, Jr. | 89/140 |
| 2,596,293 | A | * | 5/1952 | Schalkli | 89/33.02 |
| 2,833,182 | A | * | 5/1958 | Houston et al. | 89/33.02 |
| 4,004,490 | A | * | 1/1977 | Dix et al. | 89/33.02 |
| 4,207,797 | A | | 6/1980 | Gyorik | |
| 4,445,418 | A | * | 5/1984 | Sullivan et al. | 89/33.02 |
| 4,457,208 | A | * | 7/1984 | Golden | 89/33.02 |
| 4,676,137 | A | | 6/1987 | Stockton et al. | |
| 4,742,756 | A | * | 5/1988 | Mannhart | 89/33.02 |
| 4,766,800 | A | | 8/1988 | Miller et al. | |
| 4,888,898 | A | | 12/1989 | Miller et al. | |
| 4,945,664 | A | | 8/1990 | Miller | |
| 4,947,572 | A | | 8/1990 | Miller et al. | |
| 4,962,604 | A | | 10/1990 | Miller | |
| 4,965,951 | A | | 10/1990 | Miller | |
| 5,335,579 | A | | 8/1994 | David | |
| 5,520,171 | A | | 5/1996 | David | |
| 6,601,496 | B1 | | 8/2003 | Kalashnikov | |

* cited by examiner

*Primary Examiner* — Bret Hayes
*Assistant Examiner* — Reginald Tillman, Jr.
(74) *Attorney, Agent, or Firm* — Vista IP Law Group LLP

(57) ABSTRACT

An ammunition magazine and gun/magazine system in which the magazine comprises an outer housing having a substantially cylindrical inner wall surface. An inner support member is mounted within the housing and has a substantially cylindrical outer wall surface which is concentric and opposing said inner wall surface of said housing. The outer wall surface and the inner wall surface form a gap between them. A helical ramp is disposed within the gap and has a concentric axis to the inner wall surface and said outer wall surface. The helical ramp forms a helical gap within the gap, which is configured to receive a plurality of cartridges such that a longitudinal axis of each cartridge is oriented radially of the inner wall surface within the helical gap. The magazine also includes a drive mechanism for advancing the cartridges along the helical ramp.

20 Claims, 6 Drawing Sheets

HELICAL AMMUNITION MAGAZINE

FIELD OF THE INVENTION

The present invention relates generally to firearms, and more particularly to ammunition magazines for firearms and magazine/firearm systems.

BACKGROUND OF THE INVENTION

Firearms, or guns, such as pistols, handguns and rifles are designed to fire ammunition, usually cartridges, to propel a projectile, such as bullet or buckshot, or the like towards a target. Generally, a firearms cartridge comprises a metallic casing which packages primer, gunpowder, and a bullet (or other projectile(s)), into a single metallic case precisely made to fit the firing chamber of a firearm. The primer is a small charge of impact-sensitive chemical that may be located at the center of the case head (centerfire ammunition) or at its rim (rimfire ammunition).

In order to carry and feed multiple cartridges to the firing chamber, many firearms have "magazines" which hold a number of cartridges and feed the cartridges to the firing chamber. The magazine functions by moving the cartridges stored in the magazine into a position where they may be loaded into the firing chamber by the action of the firearm. Examples of magazines including drum-type ammunition for automatic machine guns, "banana"-type clips for automatic and semi-automatic assault weapons, and magazine clips for many types of pistols and rifles. Typically, the cartridges are loaded into the magazine by inserting them through a feeder on the magazine. For instance, with a conventional stacking magazine, the cartridges are pushed into the cartridge laterally (on their side), into the magazine against the force of a spring-loaded follower which pushes the cartridges through the feeder and into the firing chamber.

Ammunition cartridges may be fixed on the firearm, or removable (detachable) from the firearm. A removable magazine allows the firearm to be reloaded by simply removing a spent magazine and installing a loaded magazine. This procedure can significantly increase the speed with which a firearm can be reloaded.

Ammunition magazines have been developed in a variety of shapes and sizes to accommodate certain purposes. For instance, some magazines are designed into the handles of the firearms, some extend outward from the body of the firearm, and some are aligned with the body of the firearm. Magazines also come in many different capacities (the number of cartridges they can hold). The capacity of a magazine is limited by factors such as size, weight, handling and overall dimensions. Thus, it is advantageous for a magazine to be compact and light, but still have a large capacity.

A number of designs directed at providing a compact, ergonomic, high capacity magazine have been previously described. For example, a number of cylindrical magazines having helically arranged cartridges are described in U.S. Pat. No. 4,766,800, issued Aug. 30, 1988, to Miller et al., U.S. Pat. No. 4,947,572, issued Aug. 14, 1990, to Miller et al., U.S. Pat. No. 6,601,496, issued Aug. 5, 2003, to Kalashnikov et al. and U.S. Pat. No. 4,676,137, issued Jun. 30, 1987, to Stockton et al. In all of the magazines described in these references, the cartridges are aligned parallel to the axis of the cylinder, and the magazines are designed to be attached to the firearms with the longitudinal axes of the magazines aligned parallel to the barrel of the firearm. This is necessary because this orientation aligns the cartridges with the firing chamber of the firearm as the cartridges are inserted in to the firing chamber.

Indeed, one of the goals of this type of design was to provide a cartridge in which the longitudinal axis is parallel to the barrel of the firearm to avoid having a magazine extending perpendicular to the barrel, as such a configuration was described to be prohibitively cumbersome.

However, these previous designs are relatively complex, making them potentially difficult to manufacture and unreliable. Moreover, there are many firearms where it is desirable to have the magazine extend perpendicular from the barrel of the gun, and these prior designs cannot be so oriented because such orientation would align the cartridges perpendicular to the firing chamber. For example, in the case where the magazine is inserted into, or is used as, a handle or hand grip for the firearm, it may be desirable for the magazine to extend outward from the barrel, not parallel to the barrel. Accordingly, there is a need for an ammunition magazine and firearm which overcomes the deficiencies of previous devices.

SUMMARY OF THE INVENTION

The present invention is directed to an ammunition magazine with an increased capacity relative to its overall dimensions in comparison to other magazine designs, such as a linear or banana-type magazine, and also to the ammunition magazine in combination with a gun. The magazine also orients the cartridges such that the magazine extends outward from the barrel of the gun.

Accordingly, in one embodiment, the present invention is an ammunition magazine for holding and delivering a plurality of cartridges. The magazine comprises an outer housing having a substantially cylindrical inner wall surface defining a center axis. An inner support member is mounted within the housing and has a substantially cylindrical outer wall surface which is concentric and opposing said inner wall surface of said housing. Thus, the outer wall surface and the inner wall surface form a gap between them. A helical ramp is disposed within the gap and has a concentric axis to the inner wall surface and said outer wall surface. The helical ramp forms a helical gap within the gap, which is configured to receive a plurality of cartridges such that a longitudinal axis of each cartridge is oriented radially of the inner wall surface within the helical gap. The magazine also includes a drive mechanism for advancing the cartridges along the helical ramp.

Thus, the cartridges are oriented substantially perpendicular to the center axis of the housing. In this way, as the cartridges exit one end of the magazine, the cartridges are perpendicular to the center axis of the housing so that the magazine is installed on a firearm with the attachment point perpendicular to the firing chamber and barrel of the firearm.

In another aspect of the present invention, the drive mechanism may comprise a pusher for pushing the cartridges along the helical ramp and a spring coupled to the pusher which pushes the pusher along the helical ramp. For instance, the pusher may engage the first cartridge loaded into the magazine, and the pusher is pushed and travels down (assuming the feeder is at the top of the magazine) the helical ramp along with the first cartridge. As additional cartridges are pushed into the magazine, the previously loaded cartridges travel down the helical ramp, thereby compressing or winding the spring (depending upon the type of spring utilized).

The helical configuration of the cartridges allows the magazine to have a capacity much greater than a conventional linear or banana-type magazine, having the same longitudinal length. It is estimated that the magazine of the present invention can hold at least 50% more cartridges than a conventional linear or banana-type magazine in the same length. Thus, the present invention provides an innovative, yet simple design for a compact, high capacity, ammunition magazine.

In another embodiment, the present invention is directed to a gun and magazine system, including a gun with the above-described magazine. The magazine is attached to the gun such that a feeder of the magazine delivers the cartridges to the firing chamber of the gun.

In another aspect of the present invention, the gun and magazine system is configured such that the magazine is removable, such that the gun can be reloaded by removing a spent magazine and installing a loaded magazine.

DETAILED DESCRIPTION OF THE INVENTION

Figure 1:
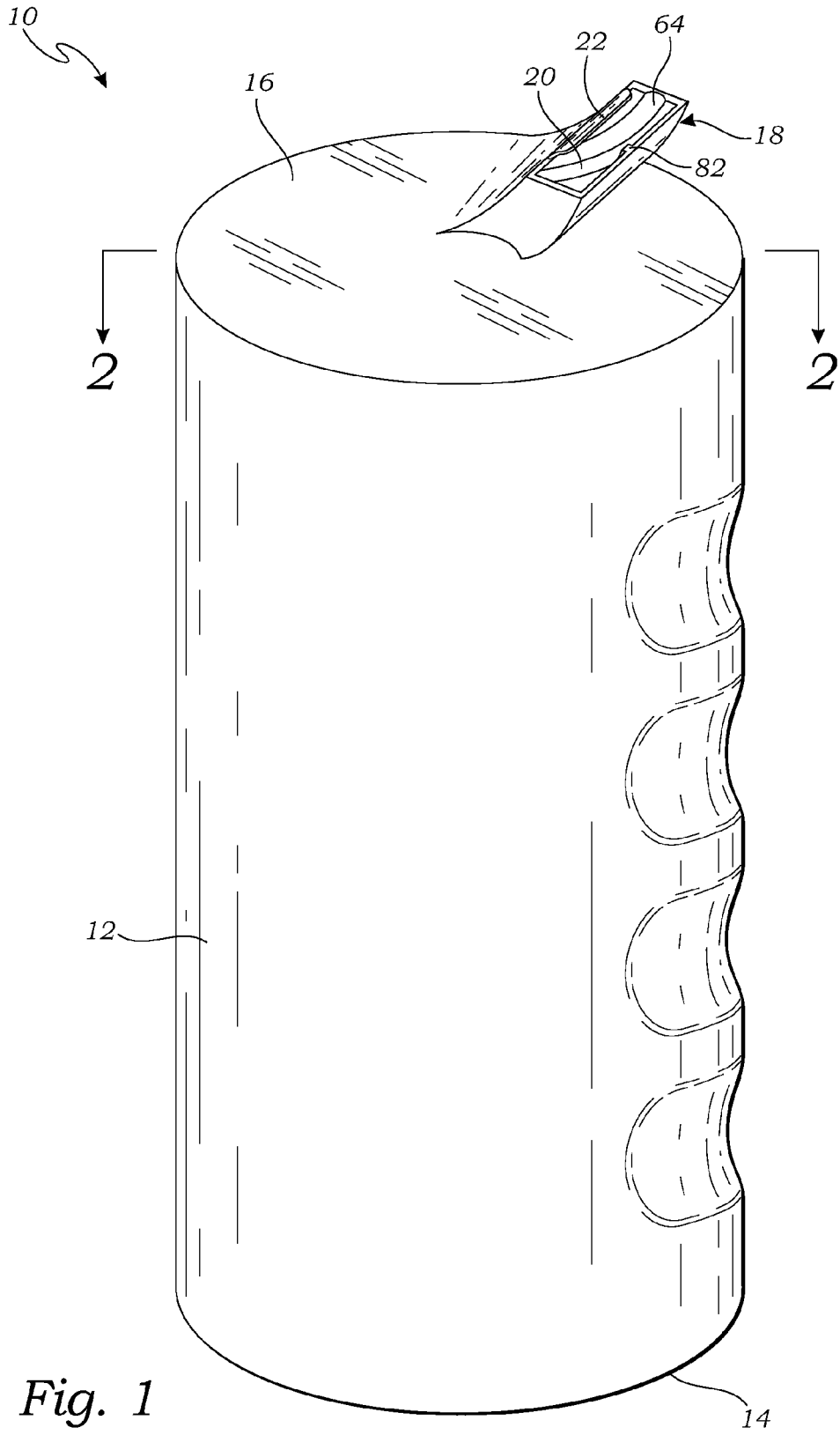
FIG. 1 is a perspective view of an ammunition magazine according to one embodiment of the present invention.

Turning to FIG. 1, an ammunition magazine 10 according to one exemplary embodiment of the present invention is shown. The magazine 10 comprises a generally cylindrical outer housing 12, a bottom end cap 14 and a top end cap 16. The top end cap 16 has a feeder 18 which feeds the cartridges stored within the housing 12 into the firing chamber of a gun. The feeder 18 has a feed ramp (not shown) which extends from a helical ramp 30 (see FIGS. 2-4) to the opening 20 at the top of the feeder 18. A pair of retractable or pliable retention tabs 22 hold the cartridges within the magazine 10 when it is not attached to a gun.

The magazine 10 may be permanently attached to a gun, such as by being integrally formed with the gun, welded to the gun, or otherwise affixed to the gun in a manner not intended to be removed. In such case, the magazine 10 is attached to the gun with the opening 20 of the feeder 18 outlets into the firing chamber of the gun.

More preferably, the magazine 10 is detachable from the gun such that the gun can be simply and quickly reloaded by removing one magazine 10 and installing another magazine 10. In a detachable configuration, the top end cap 16 may have an attachment interface which connects to a receptacle interface on the gun. For example, the feeder 18 may be configured with a detent that detachably connects to the receptacle interface on the gun. In this way, only a part of the feeder 18 needs to insert into the receptacle interface on the gun. Alternatively, the receptacle interface on the gun can be a receptacle that receives and encloses the entire magazine (similar to the way a clip inserts into the handle of some types of pistols).

Figure 8A:
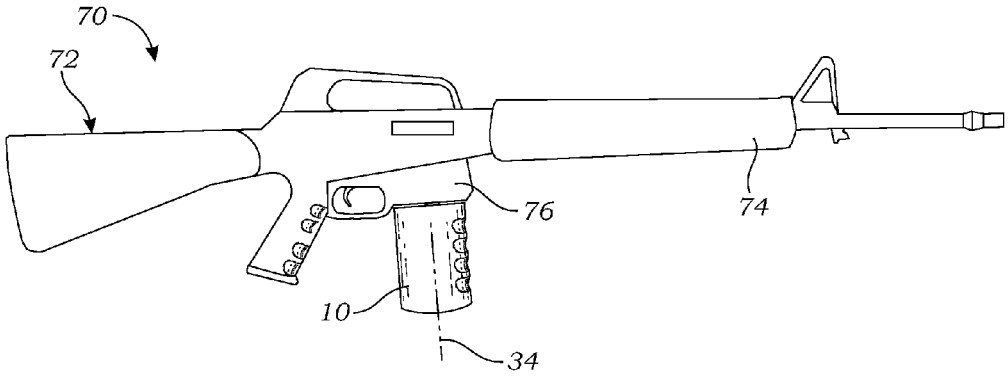
FIG. 8*a* is a side view of a magazine and gun system according to still another embodiment of the present invention.
Figure 8B:
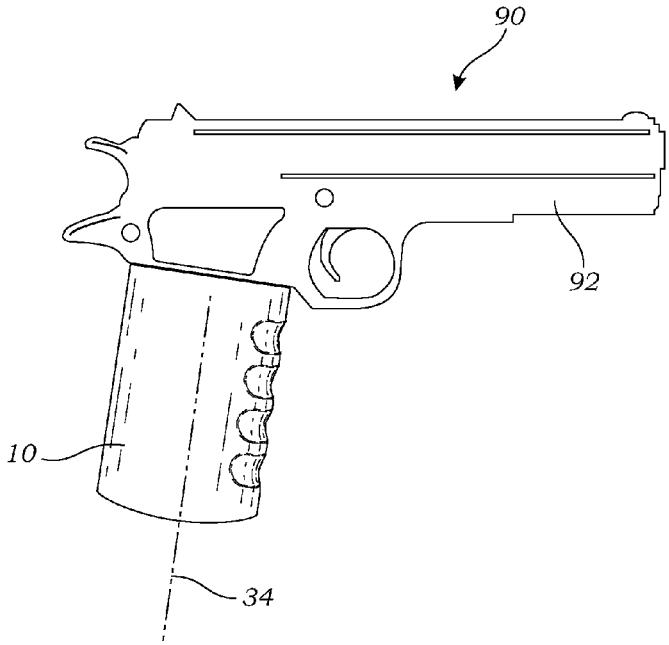
FIG. 8*b* is a side view of another magazine and gun system according to still another embodiment of the present invention.

The magazine 10 may be configured to function as a handle on a gun. For example, the outer housing 12 may have finger grips, grooves, or knurling, so that a user may hold onto the magazine when using the gun. In such a configuration, the magazine 10 is attached to the gun in a location which is suitable for handling the gun, when shooting the gun, and/or when carrying the gun. For instance, in FIG. 8*a*, on a rifle, the magazine 10 may be located on a rifle 72 where a user would hold the rifle 72 with one hand, while the other hand holds the gun near the trigger. In another example shown in FIG. 8*b*, the magazine 10 may be located at the handle of a pistol 90, so that the user holds the magazine 10, and can also reach the trigger with the trigger finger. The magazine 10 is located at the butt end of the pistol 90 and extends at about a right angle from the barrel 92 and firing chamber of the pistol 90.

The magazine 10 shown in FIG. 1 has the same or similar elements and configuration in each of the different embodiments 10*a* and 10*b* described below.

Figure 2:
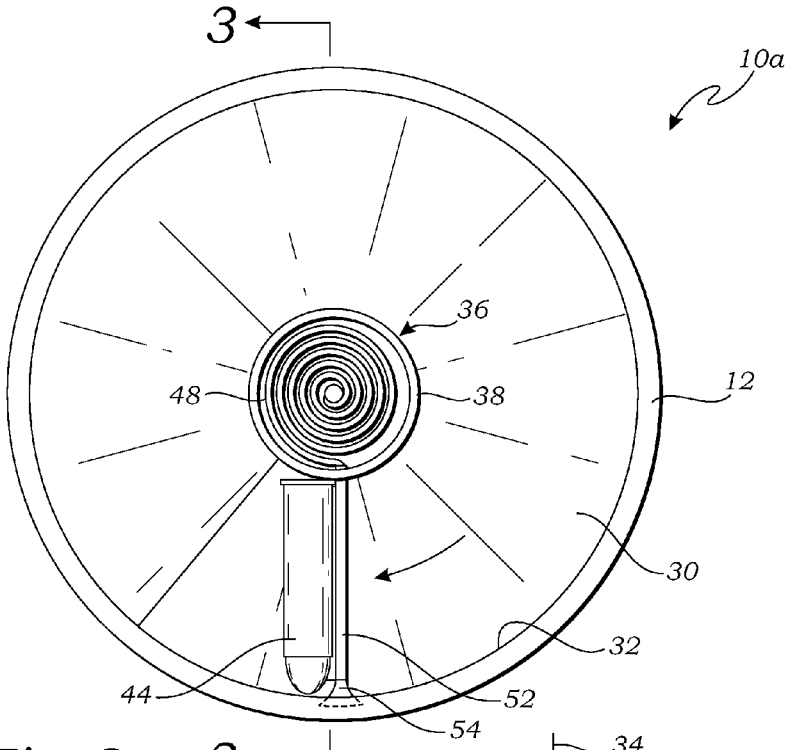
FIG. 2 is a cutaway top view of the ammunition magazine of FIG. 1 taken along line 2-2 of FIG. 1, according to one embodiment of the present invention.
Figure 3:
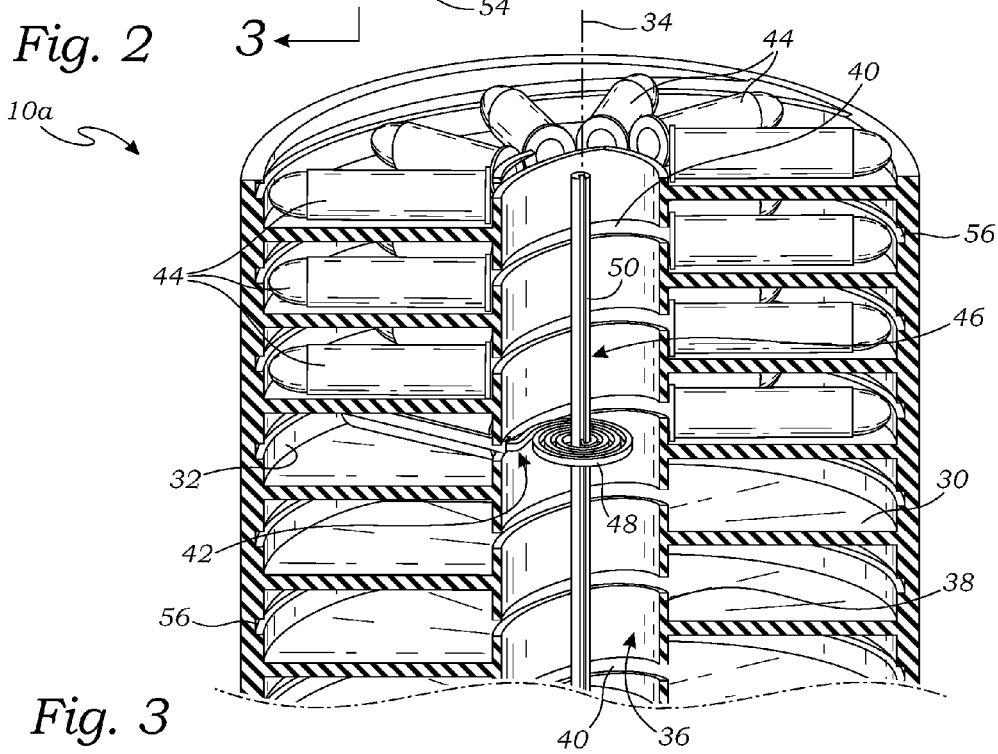
FIG. 3 is cross-sectional elevation view taken along line 3-3 of FIG. 2.
Figure 4:
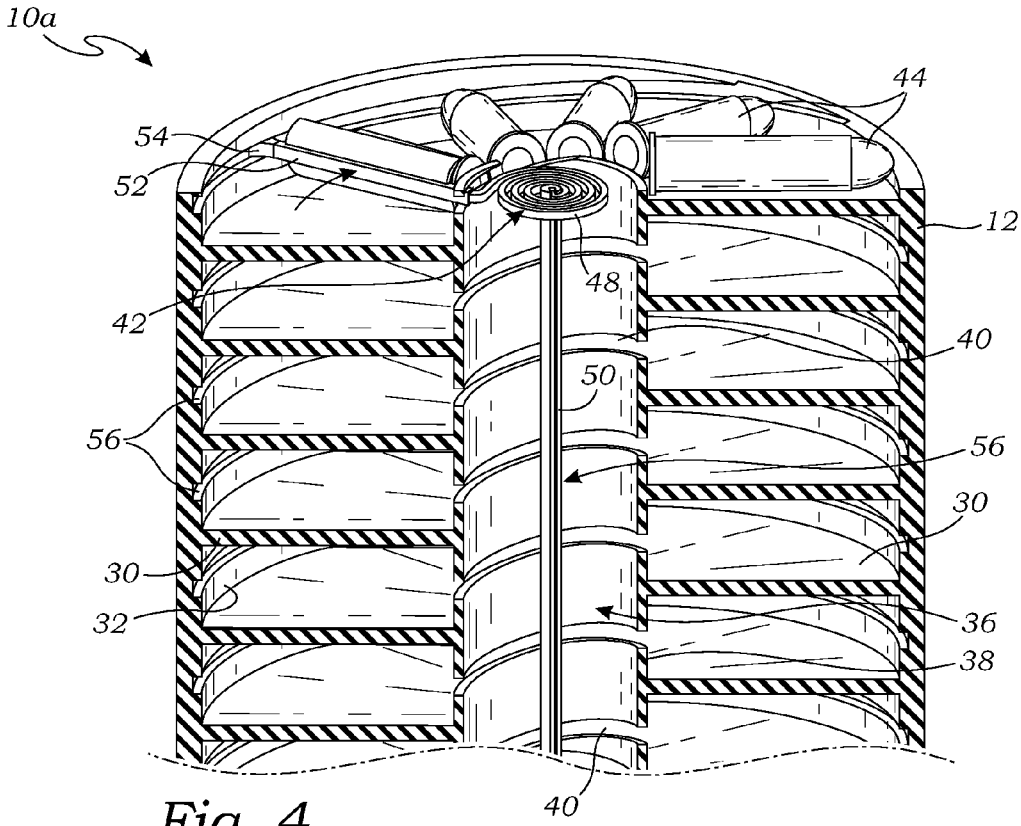
FIG. 4 is another cross-section elevation view taken along line 3-3 of FIG. 2, with the cartridges and drive mechanism in a different position than FIG. 3.

Turning now to FIGS. 2-4, the interior of the gun magazine 10*a* according to one embodiment of the present invention is shown. The outer housing 12 of the gun magazine 10*a* has a substantially cylindrical inner wall surface 32. The cylindrical inner wall surface 32 has a center axis 34 at the center of the cylindrical inner wall surface 32. An inner support member 36 is disposed within the outer housing 12 and has a substantially cylindrical outer wall surface 38 which is concentric and opposing the inner wall surface 32 of the outer housing 12. In the embodiment of FIGS. 2-4, the inner support member 36 is comprised of a plurality of cylindrical segments which extend the length of the magazine 10*a*. The segments are separated by a helical slot 40 for accommodating a pusher assembly 42.

The outer wall surface 38 and the inner wall surface 32 form a gap between them having a toroidal cross section. The helical ramp 30 is disposed within the gap. The helical ramp 30 spirals around the center axis 34 such that the helical ramp 30 is concentric to the inner wall surface 32 and outer wall surface 38. The pitch of the helical ramp (the width of one complete helix turn measured parallel to the axis of the helix) is slightly larger than the width of the cartridges 44 which the magazine 10*a* is designed to handle. Thus, the helical ramp 30 forms a helical gap between turns of the ramp which is sized and configured to receive the cartridges 44. Moreover, the helical ramp 30 is configured to receive the cartridges 44 such that the longitudinal axis of each cartridge is oriented radially of the inner wall surface 32 (pointing along a radius of the substantially cylindrical wall) within the helical gap formed by the helical ramp 30.

The magazine 10*a* also comprises a drive mechanism, which is a pusher assembly 42 in the embodiment of FIGS. 2-4. The pusher assembly 42 comprises a spring 48 slidably disposed on a spring support bar 46. The spring 48 as shown in the embodiment of FIGS. 2-4 is a flat, torsion spring, but may be any suitable torsion spring. The spring support bar 46 extends from the bottom end of the helical ramp 30 to the top end of the helical ramp 30. The spring support bar 46 has a linear groove 50 extending along its entire length for receiving the inner end of the spring 48, which prevents the inner end of the spring 48 from rotating. A pusher 52 is coupled to the outer end of the spring 48. The pusher 52 may be a bar that bears against the first cartridge 44 within the magazine, or a tray that holds the first cartridge, or other suitable structure for pushing the cartridges along the helical ramp 30. The pusher 52 extends through the helical slot 40 in the inner support member 36. The pusher 52 may also have a guide part 54 that slides along a helical groove 56 in the inner wall surface 32 of the outer housing 12. The helical groove 56 may be positioned about midway between each turn of the helical ramp 30. The guide 54 part and helical groove 56 provide support for the pusher 52 so that the pusher does not get stuck or out of proper position.

In another aspect, the tips of the bullets may also be received within the helical groove 56 to provide support for the cartridges 44. This helps keep the cartridges properly spaced and aligned within the magazine 10*a*, thereby preventing jamming of the magazine 10*a*. Alternatively, a separate helical tip groove may be provided in the inner wall surface 32 for receiving the tips of the bullets. The separate tip groove may be above or below the helical guide groove 56, or even over the helical guide groove (for example, the guide groove 56 can be deeper in the inner wall surface than the tip groove).

The function of the magazine 10*a* is very straight forward. To load the magazine 10*a*, cartridges are pushed into the feeder 18. The first cartridge pushed into the feeder 18 engages the pusher 52, which is at the top of the helical ramp 30 when the magazine 10*a* is empty. As additional cartridges are loaded into the feeder 18, the pusher 52 is pushed down and around the helical ramp 30, which in turn winds the spring 48 against the torsional force of the spring 48. The spring 48 also slides down the spring support bar 46 as the pusher 52 travels down the helical ramp 30. After the magazine 10*a* is loaded, the magazine is installed on a gun. The spring 48 exerts a torsional force on the pusher 52, which in turn pushes the cartridges up the helical ramp 30, out of the feeder 18, and into the firing chamber of the gun. As the cartridges 44 in the magazine are delivered out of the feeder 18 and fired by the gun, the pusher assembly 42 pushes the cartridges 44 up the helical ramp toward the feeder 18. FIG. 3 shows the magazine 10*a* with more cartridges within the magazine 10*a*, while FIG. 4 shows that the some of the cartridges have been spent or removed from the magazine 10*a*. As can be seen by comparing FIG. 3 to FIG. 4, as the pusher 52 pushes the cartridges up the ramp 30 by rotating around the center axis 34, the spring 48 moves upward by sliding along the spring support bar 46.

Figure 5:
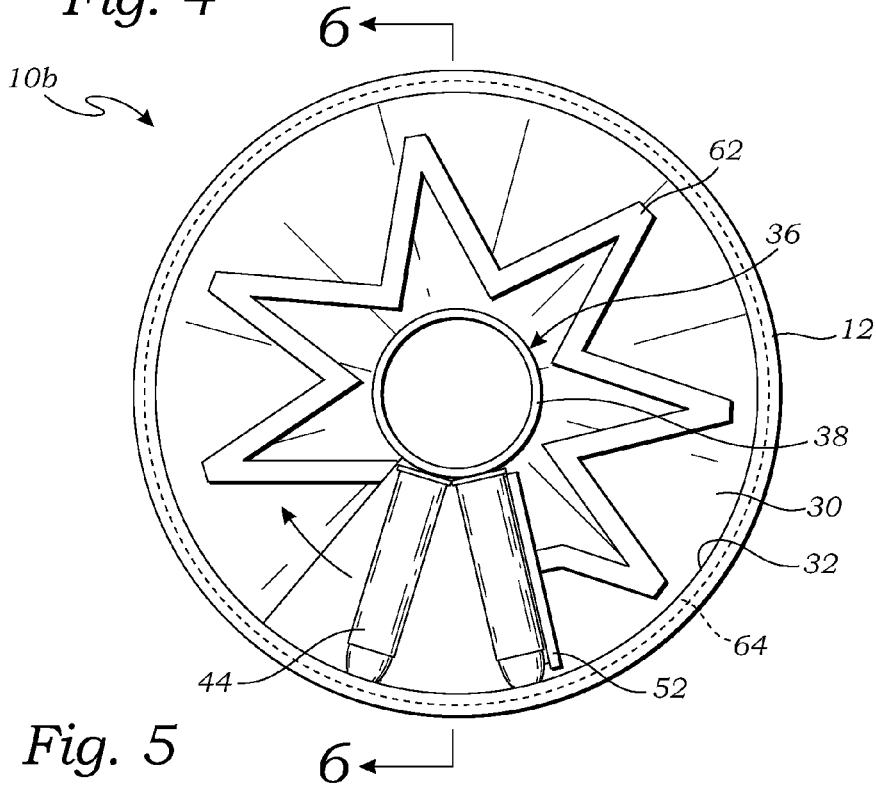
FIG. 5 is a cutaway top view of the ammunition magazine of FIG. 1 taken along line 2-2 of FIG. 1, according to another embodiment of the present invention.
Figure 6:
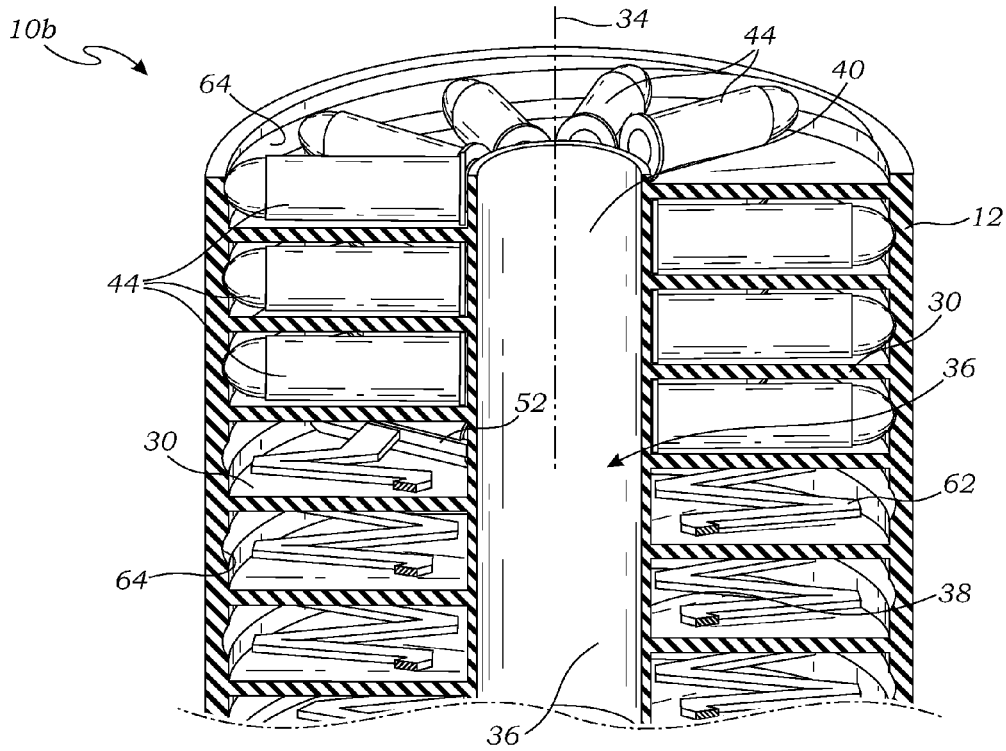
FIG. 6 is cross-sectional elevation view taken along line 6-6 of FIG. 5.
Figure 7:
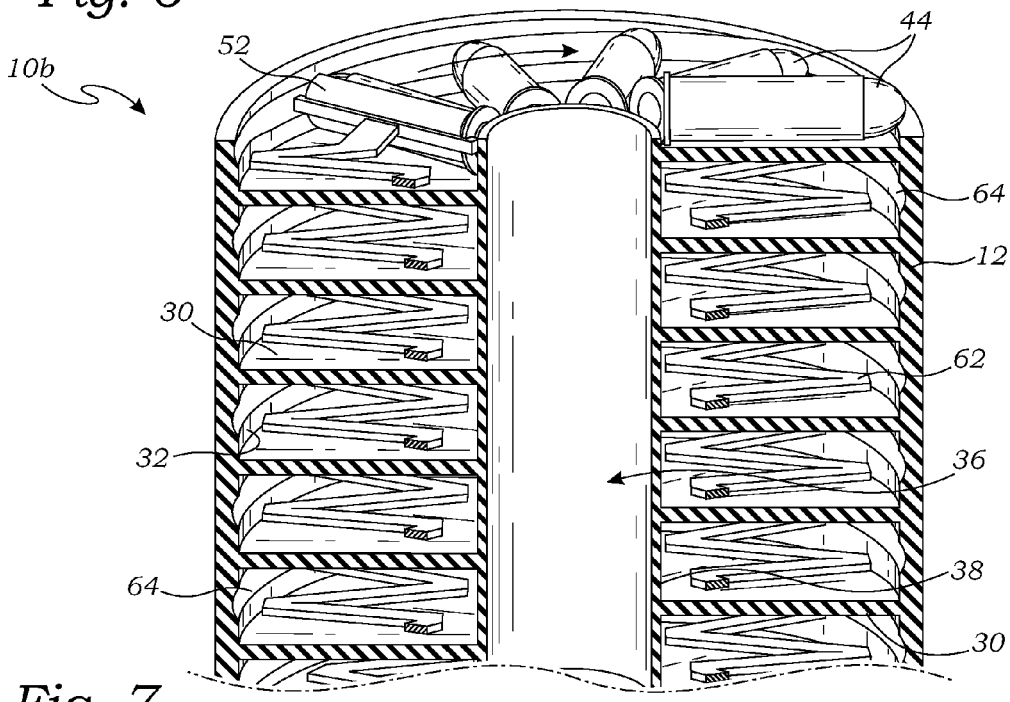
FIG. 7 is another cross-section elevation view taken along line 6-6 of FIG. 5, with the cartridges and drive mechanism in a different position than FIG. 6.

Referring now to FIGS. 5-7, the interior of a gun magazine 10*b* according to another embodiment of the present invention is shown. The gun magazine 10*b* has many of the same, or very similar components as the magazine 10*a*, wherein like reference numerals refer to like elements. Therefore, the description above with the respect to the magazine 10*a* applies equally for like elements utilized in the magazine 10*b*. The main difference between the magazine 10*b* and magazine 10*a* is the drive mechanism.

The pusher assembly of the magazine 10*b* comprises a pusher 52 which is attached to a spring 62. The spring 62 may be a zig-zag spring as shown in FIGS. 5-7, or other suitable spring. The spring 62 is arranged along the helical ramp 30 in a helical path. The top end of the spring 62 is attached to the pusher 52. The bottom end of the spring 62 may bear against a stop at the bottom of the magazine 10*b*, or the bottom end cap 14.

Like the magazine 10*a*, the pusher 52 for magazine 10*b* may have a guide part 54 that slides along a helical groove 56 in the inner wall surface 32 of the outer housing 12. The helical groove 56 may be positioned about midway between each turn of the helical ramp 30.

To support the inside end of the pusher 52, the pusher 52 may have an inside guide part (not shown) that is received in an inside helical groove in the outer wall surface 38 of the inner support member 36.

As with magazine 10*a* described above, the tips of the bullets in magazine 10*b* may also be received within the helical groove 56 to provide support for the cartridges 44. This helps keep the cartridges properly spaced and aligned within the magazine 10*a*, thereby preventing jamming of the magazine 10*a*. Alternatively, a separate helical tip groove 64 may be provided in the inner wall surface 32 for receiving the tips of the bullets. The separate tip groove 64 may be above or below the helical guide groove 56, or even over the helical guide groove (for example, the guide groove 56 can be deeper in the inner wall surface than the tip groove). As shown in FIG. 1, the helical tip groove may extend all the way into the feeder 18.

The function of the magazine 10*b* is very similar to the function of the magazine 10*a*, except that instead of compressing and decompressing a torsional spring, the movement of the pusher 52 and cartridges 44 compress the spring 62 which is placed along the helical ramp 30. The first cartridge pushed into the feeder 18 engages the pusher 52, which is at the top of the helical ramp 30 when the magazine 10*b* is empty. As additional cartridges are loaded into the feeder 18, the pusher 52 is pushed down and around the helical ramp 30, which in turn compresses the spring 62 against the spring force of the spring 62. The top end of the spring 62 travels down the helical ramp 30 as the pusher 52 travels down the helical ramp 30. After the magazine 10*b* is loaded, the magazine is installed on a gun. The spring 62 exerts a spring force on the pusher 52, which in turn pushes the cartridges up the helical ramp 30, out of the feeder 18, and into the firing chamber of the gun. As the cartridges 44 in the magazine are delivered out of the feeder 18 and fired by the gun, the pusher assembly 60 pushes the cartridges 44 up the helical ramp toward the feeder 18. FIG. 6 shows the magazine 10*b* with more cartridges within the magazine 10*b*, while FIG. 7 shows that the some of the cartridges have been spent or removed from the magazine 10*b*. As can be seen by comparing FIG. 6 to FIG. 7, as the pusher 52 pushes the cartridges up the ramp 30, the top end of the spring 62 moves up the ramp 30.

Figure 9:
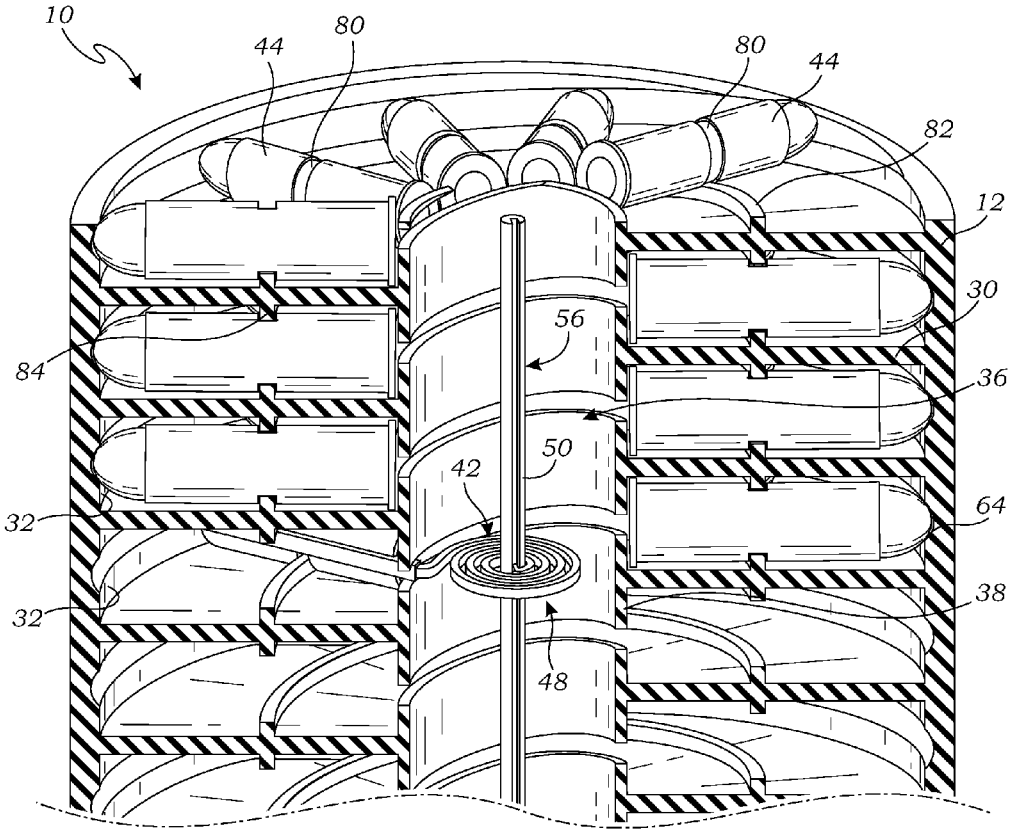
FIG. 9 is an enlarged, perspective view of a portion of a magazine according to another embodiment of the present invention.

In another aspect of the present invention, as shown in FIG. 9, the casing of the cartridges 44 may have a radial groove 80 which receives a guide rail 82 on the helical ramp 30. The guide rail 82 is positioned on the ramp 30 to align with the radial groove 80 and the guide rail 82 extends from the bottom of the helical ramp 30 to the top of the helical ramp, along a helical path. The guide rail 82 may also extend into the feeder 18 (see FIG. 1). The radial groove and 80 and guide rail 82 also helps to keep the cartridges properly aligned in a radial orientation with the magazine, which also helps to prevent jamming within the magazine. Optionally, a second guide rail 84 parallel may also be provided on the bottom side of the helical ramp 30 which is also received within the radial groove 80, and provides additional support to the cartridges 44. In another aspect, the casing of the cartridges 44 can have two or more radial grooves side by side on the casing of the cartridges 44, which are received in the same number of parallel guide rails 82 and/or 84 provided on the helical ramp 30. Any of the magazines 10*a*, 10*b*, or other magazine may be provided with the one or more guide rails 82 and/or 84, according to the present invention. Moreover, as shown in FIG. 1, the guide rail 18 may extend all the way into the feeder 18.

Turning to FIG. 8, a magazine and gun system 70 according to yet another embodiment of the present invention is shown.

The system 70 comprises a magazine 10, such as magazine 10*a* or 10*b* described above, and a gun 72 comprising a barrel 74 and a magazine interface 76. The magazine 10 is attached to the magazine interface 76 such that the feeder 18 of the magazine 10 delivers the cartridges to the firing chamber of the gun 72. The magazine 10 is oriented such that the center axis 34 is substantially perpendicular to the barrel 74 of the gun 72.

The magazine 10 may be permanently attached to the gun 72, or it may be detachable, as described above. In a detachable configuration, the gun preferably has a magazine interface receptacle, and the magazine detachably connects to the gun using a detent. Alternatively, other suitable attachment arrangements may be utilized.

While the present invention has been fully described above with particularity and detail in connection with what is presently deemed to be the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed is:

1. An ammunition magazine for holding and delivering a plurality of cartridges, the magazine comprising:

an outer housing having a substantially cylindrical inner wall surface defining a longitudinal axis;

an inner support member mounted within the housing and having a substantially cylindrical outer wall surface which is concentric and opposing said inner wall surface of said housing thereby forming a gap between the cylindrical inner wall surface and the cylindrical outer wall surface;

a helical ramp disposed within the gap and having a concentric axis to said inner wall surface and said outer wall surface, said helical ramp extending from said inner wall surface of said outer housing to said outer wall surface of said inner support member;

said helical ramp forming a helical gap within said gap, said helical gap configured to receive a plurality of cartridges such that a longitudinal axis of each cartridge is oriented radially of the inner wall surface within the helical gap; and a drive mechanism for advancing the cartridges along the helical ramp.

2. The ammunition magazine of claim 1, further comprising a helical groove disposed on the inner wall surface of said cylindrical inner wall surface configured to slidably receive a bullet tip of each cartridge.

3. The ammunition magazine of claim 1, wherein said drive mechanism comprises a pusher for pushing the cartridges along the helical ramp and a spring coupled to the pusher which produces a pushing force on said pusher tending to push the pusher along the helical ramp.

4. The ammunition magazine of claim 1, wherein said drive mechanism comprises:

a pusher for pushing the cartridges along the helical ramp; and a torsional spring coupled to the pusher, said torsional spring slidably disposed on a spring support bar which extends from a top of the helical ramp to a bottom of the helical ramp along the center axis.

5. The ammunition magazine of claim 4, wherein said pusher comprises a guide part which is received in a helical guide groove on the inner wall surface, and an arm which extends through a helical slot in inner support member.

6. The ammunition magazine of claim 1, wherein said drive mechanism comprises:

a pusher for pushing the cartridges along the helical ramp; and a spring coupled to the pusher, said spring extending in a helical path along the helical ramp from a bottom of the helical ramp to a top of the helical ramp, said spring configured to produce a pushing force on said pusher tending to push the pusher along the helical ramp.

7. The ammunition magazine of claim 6, wherein said pusher comprises a guide part which is received in a helical guide groove on the inner wall surface, and an inside guide part which is received in an inside helical guide groove on the outer wall surface.

8. The ammunition magazine of claim 1, wherein said helical ramp comprises a guide rail extending along the helical ramp, said guide rail configured to be received within a groove in a casing of each of the plurality of cartridges.

9. The ammunition magazine of claim 5, wherein said helical ramp comprises a guide rail extending along the helical ramp, said guide rail configured to be received within a groove in a casing of each of the plurality of cartridges.

10. The ammunition magazine of claim 6, wherein said helical ramp comprises a guide rail extending along the helical ramp, said guide rail configured to be received within a groove in a casing of each of the plurality of cartridges.

11. A gun and magazine system, comprising:

a gun; and a magazine attached to said gun, said magazine comprising, an outer housing having a substantially cylindrical inner wall surface defining a longitudinal axis, an inner support member mounted within the housing and having a substantially cylindrical outer wall surface which is concentric and opposing said inner wall surface of said housing thereby forming a gap between the cylindrical inner wall surface and the cylindrical outer wall surface;

a helical ramp disposed within the gap and having a concentric axis to said inner wall surface and said outer wall surface, said helical ramp extending from said inner wall surface of said outer housing to said outer wall surface of said inner support member;

said helical ramp forming a helical gap within said gap, said helical gap configured to receive a plurality of cartridges such that a longitudinal axis of each cartridge is oriented radially of the inner wall surface within the helical gap; and a drive mechanism for advancing the cartridges along the helical ramp.

12. The system of claim 11, wherein said magazine is detachably attached to said gun.

13. The system of claim 11, wherein said magazine further comprises a guide rail extending along the helical ramp, said guide rail configured to be received within a groove in a casing of each of the plurality of cartridges.

14. The system of claim 11, wherein said drive mechanism comprises a pusher for pushing the cartridges along the helical ramp and a spring coupled to the pusher which produces a pushing force on said pusher tending to push the pusher along the helical ramp.

15. The system of claim 11, wherein said drive mechanism comprises:

a pusher for pushing the cartridges along the helical ramp; and a torsional spring coupled to the pusher, said torsional spring slidably disposed on a spring support bar which extends from a top of the helical ramp to a bottom of the helical ramp along the center axis.

16. The system of claim 15, wherein said pusher comprises a guide part which is received in a helical guide groove on the inner wall surface, and an arm which extends through a helical slot in inner support member.

17. The system of claim 11, wherein said drive mechanism comprises:

a pusher for pushing the cartridges along the helical ramp; and a spring coupled to the pusher, said spring extending in a helical path along the helical ramp from a bottom of the helical ramp to a top of the helical ramp, said spring configured to produce a pushing force on said pusher tending to push the pusher along the helical ramp.

18. The system of claim 17, wherein said pusher comprises a guide part which is received in a helical guide groove on the inner wall surface, and an inside guide part which is received in an inside helical guide groove on the outer wall surface.

19. The system of claim 11, wherein said magazine also functions as a handle of a pistol.

20. The system of claim 11, wherein said magazine also function as a handle of a rifle.

* * * * *